US010657898B2

(12) United States Patent
Qian et al.

(10) Patent No.: US 10,657,898 B2
(45) Date of Patent: May 19, 2020

(54) PIXEL DRIVING CIRCUIT, DRIVING METHOD, ORGANIC LIGHT EMITTING DISPLAY PANEL AND DISPLAY DEVICE

(71) Applicants: BOE Technology Group Co., Ltd., Beijing (CN); Hefei Xinsheng Optoelectronics Technology Co., Ltd., Hefei (CN)

(72) Inventors: Xianrui Qian, Beijing (CN); Bo Li, Beijing (CN); Yunlong Cai, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 0 days.

(21) Appl. No.: 16/091,272

(22) PCT Filed: Feb. 27, 2018

(86) PCT No.: PCT/CN2018/077404
§ 371 (c)(1),
(2) Date: Oct. 4, 2018

(87) PCT Pub. No.: WO2018/161820
PCT Pub. Date: Sep. 13, 2018

(65) Prior Publication Data

US 2019/0156752 A1 May 23, 2019

(30) Foreign Application Priority Data

Mar. 8, 2017 (CN) ..... 2017 1 0134255

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0823* (2013.01); *G09G 2320/043* (2013.01)

(58) Field of Classification Search
CPC ..... G09G 3/3258; G09G 3/3233; G09G 2300/0823; G09G 2320/043
See application file for complete search history.

(56) References Cited

U.S. PATENT DOCUMENTS

2008/0062096 A1 3/2008 Yamashita et al.
2009/0102759 A1* 4/2009 Kawabe ..... G09G 3/3258 345/76

(Continued)

FOREIGN PATENT DOCUMENTS

CN 101202014 A 6/2008
CN 103531149 A 1/2014

(Continued)

OTHER PUBLICATIONS

May 30, 2018—(WO) International Search Report and Written Opinion application PCT/CN2018/077404 with English Translation.

*Primary Examiner* — Kwang-Su Yang
(74) *Attorney, Agent, or Firm* — Banner & Witcoff, Ltd.

(57) ABSTRACT

A pixel driving circuit, a driving method, an organic light emitting display panel and a display device, including: a data writing module, a storage module, at least one first light emitting device, a first driving module corresponding to the respective first light emitting device one-to-one, at least one second light emitting device, and a second driving module corresponding to the respective second light emitting device one-to-one.

19 Claims, 4 Drawing Sheets

(56) References Cited

U.S. PATENT DOCUMENTS

| | | | | |
|---|---|---|---|---|
| 2012/0306374 | A1 | 12/2012 | Lee et al. | |
| 2016/0019836 | A1* | 1/2016 | Qing | G09G 3/3233 345/76 |

FOREIGN PATENT DOCUMENTS

| | | | |
|---|---|---|---|
| CN | 203480806 | U | 3/2014 |
| CN | 104252845 | A | 12/2014 |
| CN | 106611586 | A | 5/2017 |
| JP | 2010127947 | A | 6/2010 |

* cited by examiner

PIXEL DRIVING CIRCUIT, DRIVING METHOD, ORGANIC LIGHT EMITTING DISPLAY PANEL AND DISPLAY DEVICE

The application is a U.S. National Phase Entry of International Application No. PCT/CN2018/077404 filed on Feb. 27, 2018, designating the United States of America and claiming priority to Chinese Patent Application No. 201710134255.0 filed on Mar. 8, 2017. The present application claims priority to and the benefit of the above-identified applications and the above-identified applications are incorporated by reference herein in their entirety.

TECHNICAL FIELD

The present disclosure relates to the field of display technology, and more particular to a pixel driving circuit, a driving method, an organic light emitting display panel and a display device.

BACKGROUND

Organic Light Emitting Diode (OLED) is one of the hotspots in today's research field of flat panel displays. As compared with liquid crystal displays (LCD). OLED displays have advantages of low power consumption, low manufacturing cost, self-illumination, wide viewing angle, and fast response speed, etc. Nowadays. OLED displays have begun to replace the traditional LCD displays in the display field such as mobile phones, tablet computers, digital cameras.

SUMMARY

The embodiments of the present disclosure provide a pixel driving circuit, a driving method, an organic light emitting display panel and a display device, with a simple structure, positive-negative switching of a gate voltage of the driving transistor can be implemented, so as to recover the threshold voltage that is drifting, thereby achieving the purpose of reducing the influence caused by drifting of the threshold voltage on stability and lifetime of the display panel.

Accordingly, an embodiment of the present disclosure provides a pixel driving circuit, comprising: a data writing module, a storage module, at least one first light emitting device, a first driving module corresponding to the respective first light emitting device one-to-one, at least one second light emitting device, and a second driving module corresponding to the respective second light emitting device one-to-one; wherein the data writing module is respectively connected to a scanning signal terminal, a data signal terminal and a node; the data writing module is configured to provide a signal of the data signal terminal to the node under control of the scanning signal terminal;

the storage module is respectively connected to a first reference signal terminal and the node; the storage module is configured to be charged under control of a signal of the node and the first reference signal terminal, and maintain a stable voltage difference between the node and the first reference signal terminal when the node is in a floating state;

the respective first driving module is respectively connected to a second reference signal terminal, the node and a first terminal of the corresponding first light emitting device, and a second terminal of the respective first light emitting device is connected to the first reference signal terminal; the respective first driving module is configured to drive the connected first light emitting device to emit light when a potential of the signal of the node is a first potential;

the respective second driving module is respectively connected to a third reference signal terminal, the node and a second terminal of the corresponding second light emitting device, a first terminal of the respective second light emitting device is connected to the first reference signal terminal; the respective second driving module is configured to drive the connected second light emitting device to emit light when a potential of the signal of the node is a second potential.

In the pixel driving circuit provided above by at least one embodiment of the present disclosure, the first driving module comprises: a first driving transistor; wherein a control electrode of the first driving transistor is connected to the node, a first electrode of the first driving transistor is connected to the second reference signal terminal, and a second electrode of the first driving transistor is connected to the first terminal of the corresponding first light emitting device.

In the pixel driving circuit provided above by at least one embodiment of the present disclosure, the first driving transistor is an N-type transistor.

In the pixel driving circuit provided above by at least one embodiment of the present disclosure, the second driving module comprises: a second driving transistor; wherein a control electrode of the second driving transistor is connected to the node, a first electrode of the second driving transistor is connected to the second terminal of the corresponding second light emitting device, and a second electrode of the second driving transistor is connected to the third reference signal terminal.

In the pixel driving circuit provided above by at least one embodiment of the present disclosure, the second driving transistor is a P-type transistor.

In the pixel driving circuit provided above by at least one embodiment of the present disclosure, the data writing module comprises: a write switching transistor; wherein a control electrode of the write switching transistor is connected to the scanning signal terminal, a first electrode of the write switching transistor is connected to the data signal terminal, and a second electrode of the write switching transistor is connected to the node.

In the pixel driving circuit provided above by at least one embodiment of the present disclosure, the storage module comprises: a capacitor, wherein the capacitor is connected between the node and the first reference signal terminal.

Correspondingly, an embodiment of the present disclosure further provides an organic light emitting display panel, comprising the pixel driving circuit provided above by an embodiment of the present disclosure.

Correspondingly, an embodiment of the present disclosure further provides a display device, comprising the organic light emitting display panel provided above by an embodiment of the present disclosure.

Correspondingly, an embodiment of the present disclosure further provides a driving method for any of the pixel driving circuit provided above according to an embodiment of the present disclosure, comprising: a first period and a second period; wherein in the first period, the data writing module provides a signal of the data signal terminal to the node under control of the scanning signal terminal; the storage module is charged under control of a signal of the node and the first reference signal terminal; the respective first driving module is configured to drive the connected first light emitting device to emit light when a potential of the signal of the node is a first potential;

in the second period, the storage module maintains a stable voltage difference between the node and the first reference signal terminal when the node is in a floating state; the respective first driving module is configured to drive the connected first light emitting device to emit light when a potential of the signal of the node is a first potential;

alternatively, in the first period, the data writing module provides a signal of the data signal terminal to the node under control of the scanning signal terminal; the storage module is charged under control of a signal of the node and the first reference signal terminal; the respective second driving module is configured to drive the connected second light emitting device to emit light when a potential of the signal of the node is a second potential;

in the second period, the storage module maintains a stable voltage difference between the node and the first reference signal terminal when the node is in a floating state; the respective second driving module is configured to drive the connected second light emitting device to emit light when a potential of the signal of the node is a second potential.

DETAILED DESCRIPTION OF THE EMBODIMENTS

To make the objectives, the technical solutions, and the advantages of the present disclosure more clear, the specific implementations of the pixel driving circuit, the driving method, the organic light emitting display panel and the display device provided by the embodiments of the present disclosure are described in detail below in connection with the accompanying drawings. The preferred embodiments described below are to be construed as illustrative and interpretative only and not to limit the present disclosure. And in a case of having no conflict, the embodiments of the present application and the features in the embodiments may be combined each other.

Unlike LCD that uses a stable voltage to control brightness, OLED is current-driven and requires a constant current to control its light emission. A pixel driving circuit is generally provided in the OLED display to drive the OLED to emit light. However, the current pixel driving circuit has a complicated structure, and since the driving transistor has a defect state inside and the driving transistor is in an operating state for a long time, drifting of its threshold voltage is gradually serious when the gate of the driving transistor is at a relatively high gate voltage for a long time, thereby accelerates the aging process of the driving transistor, which in turn affects stability and lifetime of the display panel.

Figure 1:
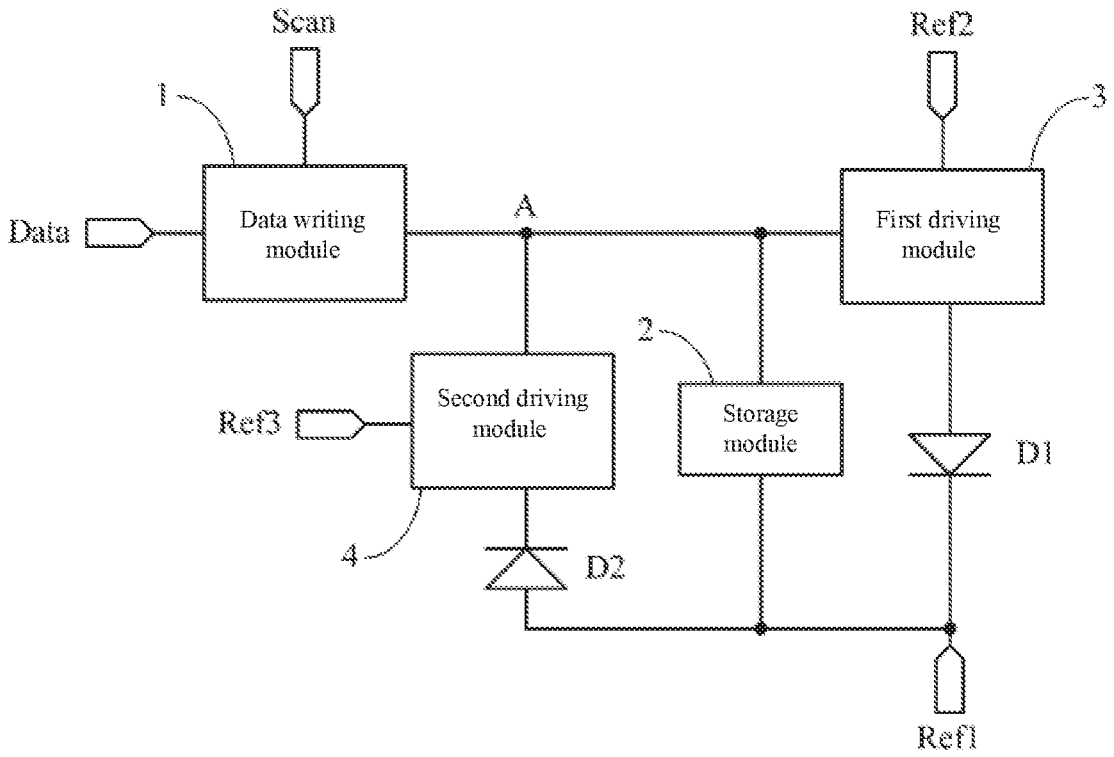
FIG. 1 is a schematic diagram of structure of a pixel driving circuit according to an embodiment of the present disclosure.

An embodiment of the present disclosure provides a pixel driving circuit, as shown in FIG. 1, the pixel driving circuit comprises: a data writing module 1, a storage module 2, at least one first light emitting device D1, a first driving module 3 corresponding to the respective first light emitting device D1 one-to-one, at least one second light emitting device D2, and a second driving module 4 corresponding to the respective second light emitting device D2 one-to-one; wherein the data writing module 1 is respectively connected to a scanning signal terminal Scan, a data signal terminal Data and a node A; the data writing module 1 is configured to provide a signal of the data signal terminal Data to the node A under control of the scanning signal terminal Scan;

the storage module 2 is respectively connected to a first reference signal terminal Ref1 and the node A; the storage module 2 is configured to be charged under control of a signal of the node A and the first reference signal terminal Ref1, and maintain a stable voltage difference between the node A and the first reference signal terminal Ref1 when the node A is in a floating state;

the respective first driving module 3 is respectively connected to a second reference signal terminal Ref2, the node A and a first terminal of the corresponding first light emitting device D1, and a second terminal of the respective first light emitting device D1 is connected to the first reference signal terminal Ref1; the respective first driving module 3 is configured to drive the connected first light emitting device D1 to emit light when a potential of the signal of the node A is a first potential;

the respective second driving module 4 is respectively connected to a third reference signal terminal Ref3, the node A and a second terminal of the corresponding second light emitting device D2, a first terminal of the respective second light emitting device D2 is connected to the first reference signal terminal Ref1; the respective second driving module 4 is configured to drive the connected second light emitting device D2 to emit light when a potential of the signal of the node A is a second potential.

The pixel driving circuit provided above by an embodiment of the present disclosure comprises: a data writing module, a storage module, at least one first light emitting device, a first driving module corresponding to the respective first light emitting device one-to-one, at least one second light emitting device, and a second driving module corresponding to the respective second light emitting device one-to-one; wherein the data writing module is configured to provide a signal of the data signal terminal to the node under control of the scanning signal terminal; the storage module is configured to be charged under control of a signal of the node and the first reference signal terminal, and maintain a stable voltage difference between the node and the first reference signal terminal when the node is in a floating state; the respective first driving module is configured to drive the connected first light emitting device to emit light when a potential of the signal of the node is a first potential; the respective second driving module is configured to drive the connected second light emitting device to emit light when a potential of the signal of the node is a second potential. The pixel driving circuit provided above by an embodiment of the present disclosure can, through mutual cooperation of the respective modules mentioned above, by adopting a simple structure, implement positive-negative switching of the voltage of the signal at the node, so as to recover performance of the first driving module and the second driving module, thereby reducing the influence caused by performance offset of the first driving module and the second driving module on stability and lifetime of the display panel.

During a specific implementation, in the pixel driving circuit provided above by an embodiment of the present disclosure, the voltage of the first reference signal terminal is a ground voltage, that is, the voltage of the first reference signal terminal is $V_{ref1}$=0V; and the voltage of the second reference signal terminal is a positive value, that is, the voltage of the second reference signal terminal is $V_{ref2}$>0V; the voltage of the third reference signal terminal is a negative value, that is, the voltage of the third reference signal terminal is $V_{ref3}$<0V. Preferably, in the pixel driving circuit provided above by an embodiment of the present disclosure, an absolute value of the voltage $V_{ref2}$ of the second reference signal terminal is equal to an absolute value of the voltage $V_{ref3}$ of the third reference signal terminal. Of course, in practical applications, the absolute value of the voltage $V_{ref2}$ of the second reference signal terminal may not be equal to the absolute value of the voltage $V_{ref3}$ of the third reference signal terminal, no limitation is made herein.

During a specific implementation, in the pixel driving circuit provided above by an embodiment of the present disclosure, when the voltage $V_A$ of the signal of the node A satisfies: $V_A$>00V, the potential of the signal of the node is a first potential; when the voltage $V_A$ of the signal of the node A satisfies: $V_A$<0V, the potential of the signal of the node is a second potential.

During a specific implementation, the pixel driving circuit provided above in the embodiment of the present disclosure may include a first light emitting device, and accordingly includes a first driving module; or may include two first light emitting devices, and accordingly include two first driving modules; or may also include three first light emitting devices, and accordingly three first driving modules; and so on, and so forth. In practical applications, the number of the first light emitting devices needs to be determined according to practice, no limitation is made herein.

During a specific implementation, the pixel driving circuit provided above in the embodiment of the present disclosure may include a second light emitting device, and accordingly includes a second driving module; or may include two second light emitting devices, and accordingly include two second driving modules; or may also include three second light emitting devices, and accordingly include three second driving modules; and so on, and so forth. In practical applications, the number of the second light emitting devices needs to be determined according to practice, no limitation is made herein.

During a specific implementation, in the pixel driving circuit provided above by an embodiment of the present disclosure, the first light emitting device and the second light emitting device are generally organic light emitting diodes. The organic light emitting diode generally includes an anode, a light emitting layer and a cathode that are disposed in a stacked way. And a first terminal of the first light emitting device is the anode of the organic light emitting diode, and a second terminal of the first light emitting device is the cathode of the organic light emitting diode. A first terminal of the second light emitting device is the anode of the organic light emitting diode, and a second terminal of the second light emitting device is the cathode of the organic light emitting diode.

During a specific implementation, in the pixel driving circuit provided above by an embodiment of the present disclosure, the cathode of the at least one first light emitting device and the cathode of the at least one second light emitting device are in common, and material of the cathode is a transparent conductive material, such as ITO, and it is disposed on an array substrate of the display panel by adopting a stacked manner. The method of manufacturing in a stacked manner is the same as that of the prior art, which should be understood by a person of ordinary skill in the art, and no limitation is made herein.

The present disclosure will be described in detail below in conjunction with specific embodiments. It should be noted that these embodiments are intended to better explain the present disclosure, but not to limit the present disclosure.

Figure 2:
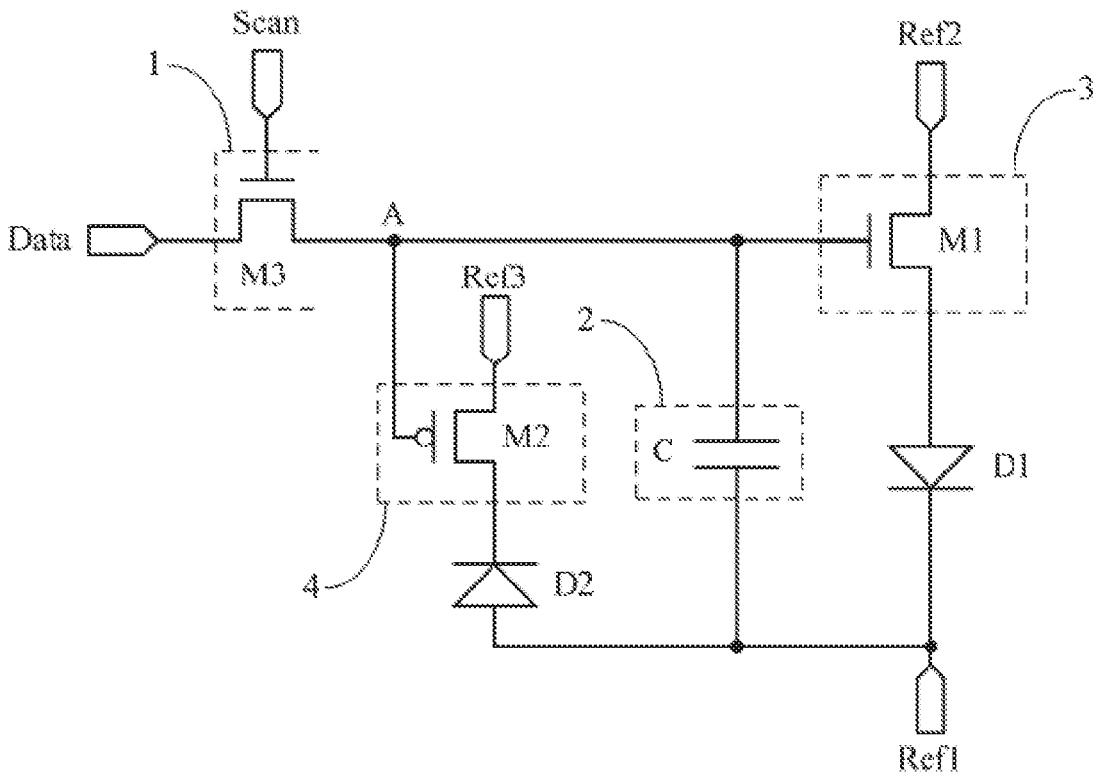
FIG. 2 is a schematic diagram of concrete structure of a pixel driving circuit according to an embodiment of the present disclosure.

Specifically, during a specific implementation, in the pixel driving circuit provided above by an embodiment of the present disclosure, as shown in FIG. 2, the first driving module 3 may specifically comprise: a first driving transistor M1; wherein a control electrode of the first driving transistor M1 is connected to the node A, a first electrode of the first driving transistor M1 is connected to the second reference signal terminal Ref2, and a second electrode of the first driving transistor M1 is connected to the first terminal of the corresponding first light emitting device D1.

During a specific implementation, in the pixel driving circuit provided above by an embodiment of the present disclosure, the first driving transistor is turned on when the potential of the signal of the node is a first potential, and a current flowing from the first electrode of the first driving transistor to the second electrode of the first driving transistor is generated.

During a specific implementation, in the pixel driving circuit provided above by an embodiment of the present disclosure, as shown in FIG. 2, the first driving transistor M1 is an N-type transistor. The gate of the N-type transistor is the control electrode of the first driving transistor M1, the source thereof is the first electrode of the first driving transistor M1, and the drain thereof is the second electrode of the first driving transistor M1. And the N-type transistor is turned on when the potential of the signal of the node A is a first potential. In practical applications, the N-type transistor is turned on, when relationship of a voltage difference $V_{gs}$(M1) between its gate and its source and its threshold voltage $V_{th}$(M1) satisfies the formula: $V_{gs}$(M1) >$V_{th}$(M1).

Specifically, during a specific implementation, in the pixel driving circuit provided above by an embodiment of the present disclosure, as shown in FIG. 2, the second driving module 4 may specifically comprise: a second driving transistor M2; wherein a control electrode of the second driving transistor M2 is connected to the node A, a first electrode of the second driving transistor M2 is connected to the second terminal of the corresponding second light emitting device D2, and a second electrode of the second driving transistor M2 is connected to the third reference signal terminal Ref3.

During a specific implementation, in the pixel driving circuit provided above by an embodiment of the present disclosure, the second driving transistor is turned on, when the potential of the signal of the node is a second potential, and a current flowing from the first electrode of the second driving transistor to the second electrode of the second driving transistor is generated.

During a specific implementation, in the pixel driving circuit provided above by an embodiment of the present disclosure, as shown in FIG. 2, the second driving transistor M2 is a P-type transistor. The gate of the P-type transistor is the control electrode of the second driving transistor M2, the source thereof is the first electrode of the second driving transistor M2, and the drain thereof is the second electrode of the second driving transistor M2. And the P-type transistor is turned on, when the potential of the signal of the node A is a second potential. In practical applications, the P-type transistor is turned on, when relationship of a voltage difference $V_{gd}$(M2) between its gate and its drain and its threshold voltage $V_{th}$(M2) satisfies the formula: $V_{gd}(M2) < V_{th}(M2)$.

Specifically, during a specific implementation, in the pixel driving circuit provided above by an embodiment of the present disclosure, as shown in FIG. 2, the data writing module 1 may specifically comprise: a write switching transistor M3: wherein a control electrode of the write switching transistor M3 is connected to the scanning signal terminal Scan, a first electrode of the write switching transistor M3 is connected to the data signal terminal Data, and a second electrode of the write switching transistor M3 is connected to the node A.

In a specific implementation, in the pixel driving circuit provided above by an embodiment of the present disclosure, as shown in FIG. 2, the write switching transistor M3 may be an N-type transistor. Of course, the write switching transistor may also be a P-type transistor, which is not limited herein.

In a specific implementation, in the pixel driving circuit provided above by an embodiment of the present disclosure, when the write switching transistor is in a turned-on state under control of the scanning signal terminal, the signal of the data signal terminal is supplied to the node.

Specifically, during a specific implementation, in the pixel driving circuit provided above by an embodiment of the present disclosure, as shown in FIG. 2, the storage module 2 may specifically comprise: a capacitor C, wherein the capacitor C is connected between the node A and the first reference signal terminal Ref1.

During a specific implementation, in the pixel driving circuit provided above by an embodiment of the present disclosure, the capacitor is charged under joint action of the signal of the node and the signal of the first reference signal terminal. When the node is in a floating state, due to a bootstrap action of the capacitor, a voltage difference between two terminals thereof can be kept stable, that is, a voltage difference between the node and the first reference signal terminal is kept stable.

The above merely illustrates concrete structure of respective modules in the pixel driving circuit provided by an embodiment of the present disclosure by examples, in a specific implementation, structure of the above respective modules is not limited to the aforesaid structure provided by an embodiment of the present disclosure, it may be other structures known to a person skilled in the art, no limitations are made herein.

During a specific implementation, in the pixel driving circuit provided above by an embodiment of the present disclosure, the N-type switching transistor is turned on under action of a high potential and turned off under action of a low potential; the P-type transistor is turned off under action of a high potential and turned on under action of a low potential.

It should be noted that, in the pixel driving circuit provided above by an embodiment of the present disclosure, each of the driving transistors and the switching transistors referred to in the above embodiment of the present disclosure may be a Thin Film Transistor, or a Metal Oxide Semiconductor Field Effect Transistor (MOS), no limitations are made herein. In a specific implementation, the control electrode of each of the driving transistors and the switching transistors is used as the gate thereof, as for the first electrode and the second electrode, according to the type of the switching transistor and the different signal of the signal terminal, the first electrode may be used as the source or the drain thereof, the second electrode may be used as the drain or the source thereof, no limitations are made herein. When describing the specific embodiment, description is provided with the driving transistors and the switching transistors being thin film transistors as an example.

Hereinafter, operation process of the pixel driving circuit provided above by an embodiment of the present disclosure will be described by taking the pixel driving circuit shown in FIG. 2 as an example and in combination with circuit timing diagrams. In the following description, 1 represents a high potential, 0 represents a low potential. It needs to be noted that 0 and 1 are a logical potential, only intended to better explain the specific operation process of the embodiment of the present disclosure, rather than to indicate a voltage applied to gates of the respective transistors in a specific implementation.

Figure 3:
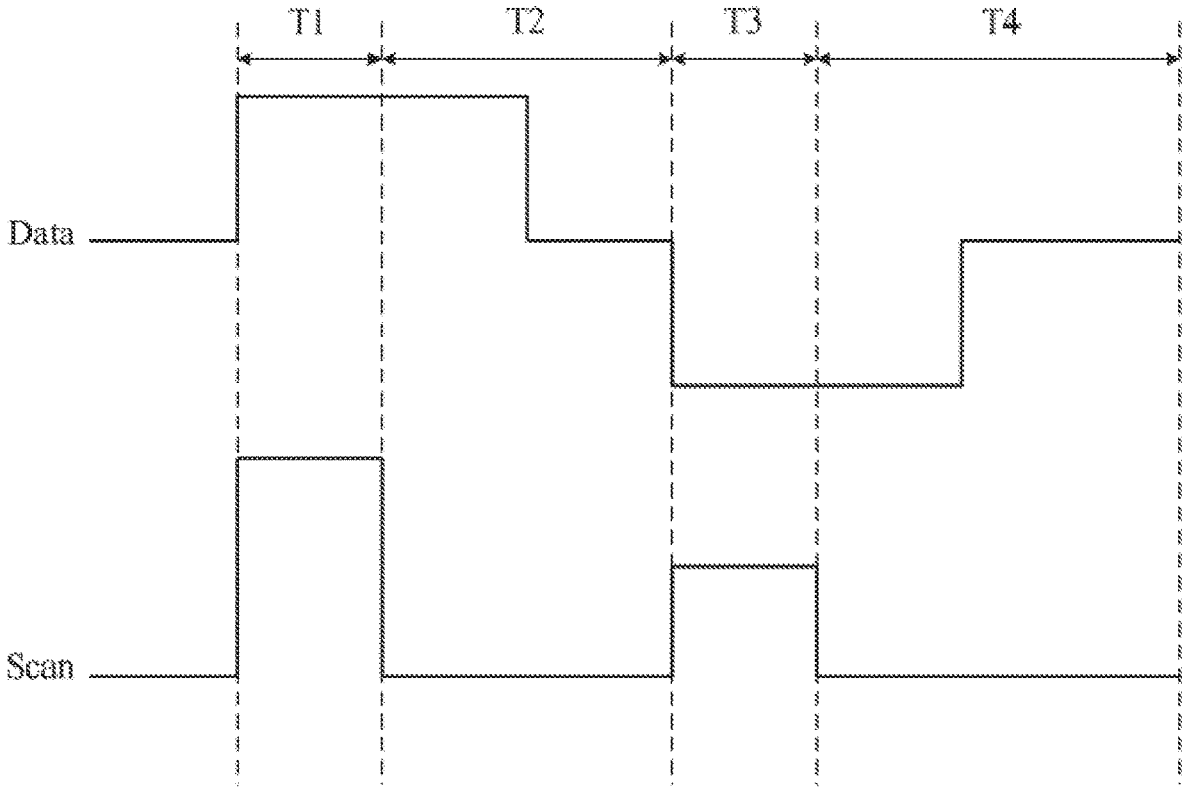
FIG. 3 is a timing diagram of the pixel driving circuit shown in FIG. 2.

In the gate driving circuit shown in FIG. 2, the first driving transistor M1 is an N-type switching transistor, the second driving transistor M2 is a P-type transistor, the write switching transistor is an N-type transistor. The corresponding input timing diagram is shown as FIG. 3. Specifically, four periods of a first period T1, a second period T2, a third period T3 and a fourth period T4 in the input timing diagram as shown in FIG. 3 are selected; wherein periods T1 and T2 are one frame of time currently displayed, and periods T3 and T4 are one frame of time to be displayed next.

In the period T1, since Scan=1, the write switching transistor M3 is turned on and provides a high potential signal of the data signal terminal Data to the node A, thus the potential of the node A is a high potential and the voltage of the node A is $V_{data}$. The capacitator C is charged under joint action of the signal of the node A and the signal of the first reference signal terminal Ref1. Because the potential of the node A is a high potential, the first driving transistor M1 is turned on and in a saturated state, the second driving transistor M2 is turned off. The voltage at the gate of the first driving transistor M1 is $V_{data}$, the voltage at the source of the first driving transistor M1 is $V_{ref2}$. According to characteristics of the current in a saturated state, it can be known that, an operating current $I_1$ that flows through the first driving transistor M1 and is used to drive the corresponding first light emitting device D1 to emit light satisfies the formula: $I_1=K(V_{gs}-V_{th}(M1))^2=K[V_{data}-V_{ref2}-V_{th}(M1)]^2$; wherein $V_{gs}$ is a gate-source voltage of the first driving transistor M1; K is a structural parameter, this numeric is relatively stable in the same structure and can be considered as a constant.

In the period T2, since Scan=0, the write switching transistor M3 is turned off, the node A is in a floating state. Due to a bootstrap action of the capacitor C, a voltage difference across two terminals of the capacitor C can be kept stable, so that the potential of the node A is kept as a high potential and the voltage of the node A is maintained at $V_{data}$. Since the potential of the node A is high, the first driving transistor M1 is turned on and in a saturated state, and the second driving transistor M2 is turned off. The voltage at the gate of the first driving transistor M1 is $V_{data}$, and the voltage at the source of the first driving transistor M1 is $V_{ref2}$. According to the current characteristics in a saturated state, it can be known that, an operating current $I_1$ that flows through the first driving transistor M1 and is used to drive the corresponding first light emitting device D1 to emit light satisfies the formula: $I_1=K(V_{gs}-V_{th}(M1))^2=K[V_{data}-$ $V_{ref2}-V_{th}(M1)]^2$; wherein $V_{gs}$ is a gate-source voltage of the first driving transistor M1; K is a structural parameter, this numeric is relatively stable in the same structure and may be considered as a constant.

In the period T3, since Scan=1, the write switching transistor M3 is turned on and provides the signal having a low potential at the data signal terminal Data to the node A, thus the potential of the node A is a low potential and the voltage of the node A is $V_{data}$. The capacitator C is charged under a joint action of the signal of the node A and the signal of the first reference signal terminal Ref1. Because the potential at the node A is a low potential, the first driving transistor M1 is turned off, the second driving transistor M2 is turned on and in a saturated state. The voltage at the gate of the second driving transistor M2 is $V_{data}$, the voltage at the drain of the second driving transistor M2 is $V_{ref3}$. According to the current characteristics in a saturated state, it can be known that, an operating current $I_2$ that flows through the second driving transistor M2 and is used to drive the corresponding second light emitting device D2 to emit light satisfies the formula: $I_2=K(V_{gd}-V_{th}(M2))^2=K[V_{data}-V_{ref3}-V_{th}(M2)]^2$; wherein $V_{gd}$ is a gate-drain voltage of the second driving transistor M2; K is a structural parameter, this numeric is relatively stable in the same structure and may be considered as a constant.

In the period T4, since Scan=0, the write switching transistor M3 is turned off, the node A is in a floating state. Due to a bootstrap action of the capacitor C, a voltage difference across two terminals of the capacitor C can be kept stable, so that the potential of the node A is kept as a low potential and the voltage of the node A is maintained at $V_{data}$. Because the potential of the node A is the low potential, the first driving transistor M1 is turned off, the second driving transistor M2 is turned on and in a saturated state. The voltage at the gate of the second driving transistor M2 is $V_{data}$, the voltage at the drain of the second driving transistor M2 is $V_{ref3}$. According to characteristics of the current in a saturated state, it can be known that, an operating current $I_2$ that flows through the second driving transistor M2 and is used to drive the corresponding second light emitting device D2 to emit light satisfies the formula: $I_2=K(V_{gd}-V_{th}(M2))^2=K[V_{data}-V_{ref3}-V_{th}(M2)]^2$; wherein $V_{gd}$ is a gate-drain voltage of the second driving transistor M2; K is a structural parameter, this numeric is relatively stable in the same structure and may be considered as a constant.

In a specific implementation, the voltage of the scanning signal terminal in the period T1 may be set higher than the voltage of the scanning signal terminal in the period T3, so that the high potential signal of the data signal terminal is written more sufficiently in the period T1, a waveform gap of the signal (high or low potential) of the data signal terminal written to the node is reduced. Of course, in the specific implementation, the data signal terminal may also be at a low potential in the period T1, and the data signal terminal may also be at a high potential in the period T3, which needs to be set and determined according to an actual application environment, no limitations are made herein.

The pixel driving circuit provided above by an embodiment of the present disclosure can, through mutual cooperation of only two driving transistors, one switching transistor and one capacitor, by adopting a simple structure, implement positive-negative switching of the voltage at the node under action of the voltage of the data signal terminal, so that when the voltage at the node is larger than 0V, the first driving transistor is controlled to be turned on to thereby be in an operating state, the second driving transistor is controlled to be turned off and its threshold voltage that drifts in an operating state is recovered; when the node voltage is less than 0V, the second driving transistor is controlled to be turned on to be in an operating state, and the first driving transistor is controlled to be turned off and its threshold voltage that drifts in an operating state is recovered, so that the threshold voltage of the first driving transistor and the threshold voltage of the second driving transistor are alternately recovered, accordingly, the influence caused by drifting of the threshold voltages of the first driving transistor and the second driving transistor on stability and lifetime of the display panel can be reduced. Moreover, the pixel driving circuit provided above by an embodiment of the present disclosure can realize relatively stable light emission through a simple control signal, thereby making structure of the peripheral driving device that outputs the control signal simple, and further enhancing lifetime of the product to a certain extent, and reducing the manufacturing cost.

Figure 4:
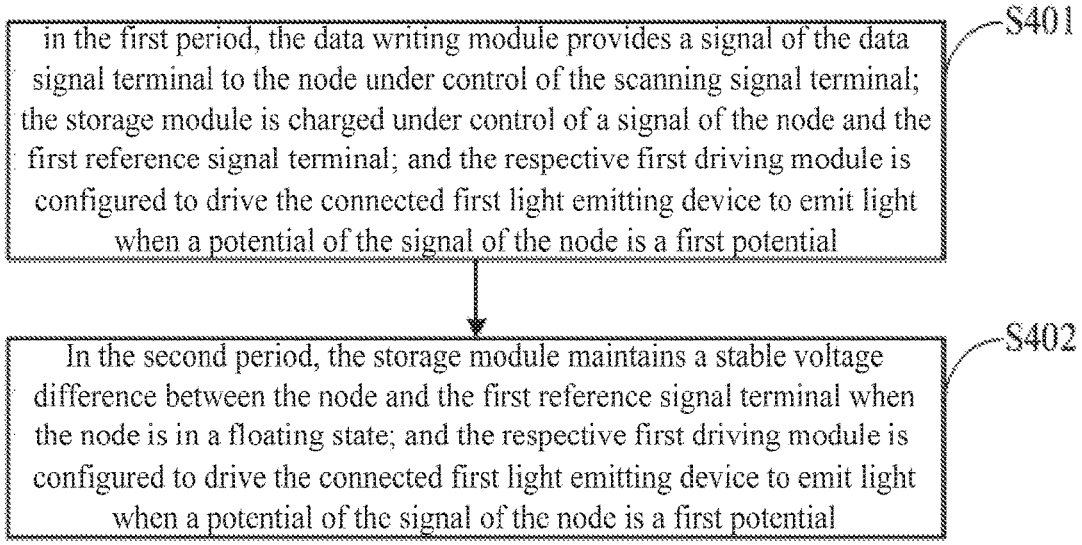
FIG. 4 is a first flowchart of a driving method for a pixel driving circuit according to an embodiment of the present disclosure.
Figure 5:
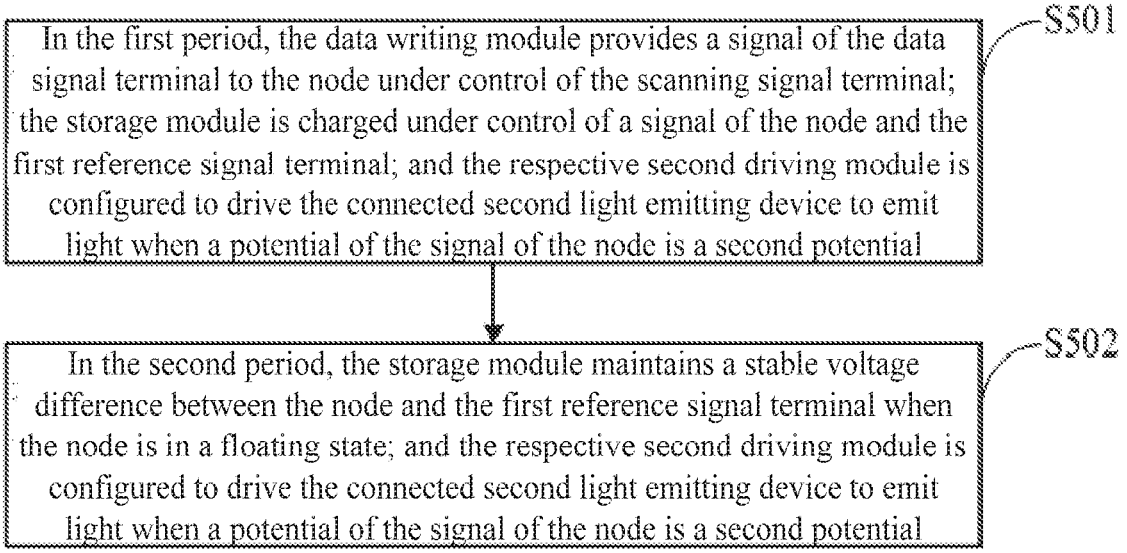
FIG. 5 is a second flowchart of a driving method for a pixel driving circuit according to an embodiment of the present disclosure.

Based on the same inventive concept, an embodiment of the present disclosure further provides a driving method for any of the pixel driving circuit provided by an embodiment of the present disclosure, as shown in FIG. 4, the driving method comprises: a first period and a second period; wherein S401, in the first period, the data writing module provides a signal of the data signal terminal to the node under control of the scanning signal terminal; the storage module is charged under control of a signal of the node and the first reference signal terminal; the respective first driving module is configured to drive the connected first light emitting device to emit light when a potential of the signal of the node is a first potential;

S402, in the second period, the storage module maintains a stable voltage difference between the node and the first reference signal terminal when the node is in a floating state; the respective first driving module is configured to drive the connected first light emitting device to emit light when a potential of the signal of the node is a first potential;

Alternatively, as shown in FIG. 5, the driving method comprises: a first period and a second period; wherein S501, in the first period, the data writing module provides a signal of the data signal terminal to the node under control of the scanning signal terminal; the storage module is charged under control of a signal of the node and the first reference signal terminal; the respective second driving module is configured to drive the connected second light emitting device to emit light when a potential of the signal of the node is a second potential;

S502, in the second period, the storage module maintains a stable voltage difference between the node and the first reference signal terminal when the node is in a floating state; the respective second driving module is configured to drive the connected second light emitting device to emit light when a potential of the signal of the node is a second potential.

In the driving method provided above by an embodiment of the present disclosure, positive-negative switching of the voltage at the node can be implemented, so as to recover performance of the first driving module and the second driving module, thereby reducing the influence caused by performance shift of first driving module and the second driving module on stability and lifetime of the display panel.

Based on the same inventive concept, an embodiment of the present application further provides an organic light emitting display panel comprising any of the pixel driving circuit provided above by an embodiment of the present disclosure. The principle of solving problems of the organic light emitting display panel is similar to that of the foregoing pixel driving circuit, therefore, implementation of the organic light emitting display panel may be referred to implementation of the foregoing pixel driving circuit, no more details are repeated herein.

Based on the same inventive concept, an embodiment of the present disclosure further provides a display device, comprising the organic light emitting display panel provided above by an embodiment of the present disclosure. The display device may be any product or component having a display function such as a mobile phone, a tablet computer, a television, a display, a notebook computer, a digital photo frame, a navigator, and so on. As for other essential components of the display device that will be understood by a person of ordinary skill in the art, no more details are repeated herein, which should not be construed as limiting the present disclosure.

The pixel driving circuit, the driving method, the organic light emitting display panel and the display device provided above by the embodiments of the present disclosure comprise: a data writing module, a storage module, at least one first light emitting device, a first driving module corresponding to the respective first light emitting device one-to-one, at least one second light emitting device, and a second driving module corresponding to the respective second light emitting device one-to-one; wherein the data writing module is configured to provide a signal of the data signal terminal to the node under control of the scanning signal terminal; the storage module is configured to be charged under control of a signal of the node and the first reference signal terminal, and maintain a stable voltage difference between the node and the first reference signal terminal when the node is in a floating state; the respective first driving module is configured to drive the connected first light emitting device to emit light when a potential of the signal of the node is a first potential; the respective second driving module is configured to drive the connected second light emitting device to emit light when a potential of the signal of the node is a second potential. Therefore, through mutual cooperation of the respective modules mentioned above, by adopting a simple structure, a positive-negative switching of the voltage of the signal at the node can be implemented, so as to recover performance of the first driving module and the second driving module, thereby reducing the influence caused by performance offset of the first driving module and the second driving module on stability and lifetime of the display panel.

The advantageous effect of the present disclosure is as follows:

The pixel driving circuit, the driving method, the organic light emitting display panel and the display device provided above by the embodiments of the present disclosure comprise: a data writing module, a storage module, at least one first light emitting device, a first driving module corresponding to the respective first light emitting device one-to-one, at least one second light emitting device, and a second driving module corresponding to the respective second light emitting device one-to-one; wherein the data writing module is configured to provide a signal of the data signal terminal to the node under control of the scanning signal terminal; the storage module is configured to be charged under control of a signal of the node and the first reference signal terminal, and maintain a stable voltage difference between the node and the first reference signal terminal when the node is in a floating state; the respective first driving module is configured to drive the connected first light emitting device to emit light when a potential of the signal of the node is a first potential; the respective second driving module is configured to drive the connected second light emitting device to emit light when a potential of the signal of the node is a second potential. Therefore, through mutual cooperation of the respective modules mentioned above, by adopting a simple structure, a positive-negative switching of the voltage of the signal at the node can be implemented, so as to recover performance of the first driving module and the second driving module, thereby reducing the influence caused by performance offset of the first driving module and the second driving module on stability and lifetime of the display panel.

Apparently, a person skill in the art can make various modifications and variations to the present disclosure without departing from the spirit and scope thereof. The present disclosure is also intended to include these modifications and variations if these modification and variations fall into the scope of the claims of the present disclosure and the equivalent techniques thereof.

The present application claims priority of the Chinese Patent Application No. 201710134255.0 filed on Mar. 8, 2017, the entire disclosure of which is hereby incorporated in full text by reference as part of the present application.

What is claimed is:

1. A pixel driving circuit, comprising: a data writing circuit; a storage circuit; at least one first light emitting device; a first driving circuit corresponding to the respective first light emitting device one-to-one; at least one second light emitting device; and a second driving circuit corresponding to the respective second light emitting device one-to-one, wherein:

the data writing circuit is respectively connected to a scanning signal terminal, a data signal terminal and a node, and the data writing circuit is configured to provide a signal of the data signal terminal to the node under control of the scanning signal terminal;

the storage circuit is respectively connected to a first reference signal terminal and the node, and the storage circuit is configured to be charged under control of a signal of the node and the first reference signal terminal, and maintain a stable voltage difference between the node and the first reference signal terminal when the node is in a floating state;

the respective first driving circuit is respectively connected to a second reference signal terminal, the node and a first terminal of the corresponding first light emitting device, and a second terminal of the respective first light emitting device is connected to the first reference signal terminal, and the respective first driving circuit is configured to drive the connected first light emitting device to emit light when a potential of the signal of the node is a first potential; and the respective second driving circuit is respectively connected to a third reference signal terminal, the node and a second terminal of the corresponding second light emitting device, a first terminal of the respective second light emitting device is connected to the first reference signal terminal, and the respective second driving circuit is configured to drive the connected second light emitting device to emit light when a potential of the signal of the node is a second potential.

2. The pixel driving circuit according to claim 1, wherein the first driving circuit comprises: a first driving transistor, wherein a control electrode of the first driving transistor is connected to the node, a first electrode of the first driving transistor is connected to the second reference signal terminal, and a second electrode of the first driving transistor is connected to the first terminal of the corresponding first light emitting device.

3. The pixel driving circuit according to claim 2, wherein the first driving transistor is an N-type transistor.

4. The pixel driving circuit according to claim 3, wherein the second driving circuit comprises: a second driving transistor, wherein a control electrode of the second driving transistor is connected to the node, a first electrode of the second driving transistor is connected to the second terminal of the corresponding second light emitting device, and a second electrode of the second driving transistor is connected to the third reference signal terminal.

5. The pixel driving circuit according to claim 3, wherein the data writing circuit comprises: a write switching transistor, wherein a control electrode of the write switching transistor is connected to the scanning signal terminal, a first electrode of the write switching transistor is connected to the data signal terminal, and a second electrode of the write switching transistor is connected to the node.

6. The pixel driving circuit according to claim 3, wherein the storage circuit comprises: a capacitor, wherein the capacitor is connected between the node and the first reference signal terminal.

7. The pixel driving circuit according to claim 2, wherein the second driving comprises: a second driving transistor, wherein a control electrode of the second driving transistor is connected to the node, a first electrode of the second driving transistor is connected to the second terminal of the corresponding second light emitting device, and a second electrode of the second driving transistor is connected to the third reference signal terminal.

8. The pixel driving circuit according to claim 2, wherein the data writing circuit comprises: a write switching transistor, wherein a control electrode of the write switching transistor is connected to the scanning signal terminal, a first electrode of the write switching transistor is connected to the data signal terminal, and a second electrode of the write switching transistor is connected to the node.

9. The pixel driving circuit according to claim 2, wherein the storage circuit comprises: a capacitor, wherein the capacitor is connected between the node and the first reference signal terminal.

10. The pixel driving circuit according to claim 1, wherein the second driving circuit comprises: a second driving transistor, wherein a control electrode of the second driving transistor is connected to the node, a first electrode of the second driving transistor is connected to the second terminal of the corresponding second light emitting device, and a second electrode of the second driving transistor is connected to the third reference signal terminal.

11. The pixel driving circuit according to claim 10, wherein the second driving transistor is a P-type transistor.

12. The pixel driving circuit according to claim 11, wherein the data writing circuit comprises: a write switching transistor, wherein a control electrode of the write switching transistor is connected to the scanning signal terminal, a first electrode of the write switching transistor is connected to the data signal terminal, and a second electrode of the write switching transistor is connected to the node.

13. The pixel driving circuit according to claim 11, wherein the storage circuit comprises: a capacitor, wherein the capacitor is connected between the node and the first reference signal terminal.

14. The pixel driving circuit according to claim 10, wherein the data writing circuit comprises: a write switching transistor, wherein a control electrode of the write switching transistor is connected to the scanning signal terminal, a first electrode of the write switching transistor is connected to the data signal terminal, and a second electrode of the write switching transistor is connected to the node.

15. The pixel driving circuit according to claim 10, wherein the storage circuit comprises: a capacitor, wherein the capacitor is connected between the node and the first reference signal terminal.

16. The pixel driving circuit according to claim 1, wherein the data writing circuit comprises: a write switching transistor, wherein a control electrode of the write switching transistor is connected to the scanning signal terminal, a first electrode of the write switching transistor is connected to the data signal terminal, and a second electrode of the write switching transistor is connected to the node.

17. The pixel driving circuit according to claim 1, wherein the storage circuit comprises: a capacitor, wherein the capacitor is connected between the node and the first reference signal terminal.

18. A display device, comprising an organic light emitting display panel, the organic light emitting display panel comprising the pixel driving circuit according to claim 1.

19. A driving method for the pixel driving circuit according to claim 1, the driving method comprising:

in a first period, providing a signal of the data signal terminal to the node under control of the scanning signal terminal by the data writing circuit, and charging the storage circuit under control of a signal of the node and the first reference signal terminal, wherein the respective first driving circuit is configured to drive the connected first light emitting device to emit light when a potential of the signal of the node is a first potential; and in a second period, maintaining a stable voltage difference between the node and the first reference signal terminal by the storage circuit when the node is in a floating state, wherein the respective first driving circuit is configured to drive the connected first light emitting device to emit light when a potential of the signal of the node is a first potential;

or, in a first period, providing a signal of the data signal terminal to the node under control of the scanning signal terminal by the data writing circuit, and charging the storage circuit under control of a signal of the node and the first reference signal terminal, wherein the respective second driving circuit is configured to drive the connected second light emitting device to emit light when a potential of the signal of the node is a second potential; and in a second period, maintaining a stable voltage difference between the node and the first reference signal terminal by the storage circuit when the node is in a floating state, wherein the respective second driving circuit is configured to drive the connected second light emitting device to emit light when a potential of the signal of the node is a second potential.

* * * * *